US008767992B2

(12) United States Patent
Lester, Jr.

(10) Patent No.: US 8,767,992 B2
(45) Date of Patent: Jul. 1, 2014

(54) MOBILE MEDIA DEVICE CASE/ATTACHMENT FOR PROVIDING PASSIVE ACOUSTIC BOOSTING

(76) Inventor: Gary A. Lester, Jr., Anchorage, AK (US)

( * ) Notice: Subject to any disclaimer, the term of this patent is extended or adjusted under 35 U.S.C. 154(b) by 0 days.

(21) Appl. No.: 13/340,978

(22) Filed: Dec. 30, 2011

(65) Prior Publication Data

US 2013/0170686 A1 Jul. 4, 2013

(51) Int. Cl.
*H04R 1/20* (2006.01)

(52) U.S. Cl.
USPC ..... 381/338; 381/351

(58) Field of Classification Search
USPC ..... 381/313, 324, 337–356; 379/430, 431, 379/433.01
See application file for complete search history.

(56) References Cited

U.S. PATENT DOCUMENTS

| | | | | |
|---|---|---|---|---|
| 5,711,013 | A | 1/1998 | Collett et al. | |
| 5,828,012 | A | 10/1998 | Repolle et al. | |
| 6,512,834 | B1 | 1/2003 | Banter et al. | |
| 6,553,125 | B2 | 4/2003 | Kobayashi et al. | |
| 6,711,274 | B2 | 3/2004 | Asahina et al. | |
| 6,785,395 | B1 | 8/2004 | Arneson et al. | |
| 6,795,563 | B2 | 9/2004 | Ohta | |
| 6,932,187 | B2 | 8/2005 | Banter et al. | |
| 7,266,213 | B2 | 9/2007 | Furuya | |
| 7,272,422 | B2 | 9/2007 | Nagasawa et al. | |
| 7,357,217 | B1 | 4/2008 | Viveros | |
| 7,505,603 | B2 | 3/2009 | Yoo | |
| 8,170,259 | B2 * | 5/2012 | Liu | 381/365 |
| 2002/0009195 | A1 * | 1/2002 | Schon | 379/454 |
| 2002/0131612 | A1 | 9/2002 | Son | |
| 2003/0044040 | A1 | 3/2003 | Lee et al. | |
| 2003/0059079 | A1 | 3/2003 | Asahina et al. | |
| 2006/0140438 | A1 | 6/2006 | Kimura et al. | |

(Continued)

FOREIGN PATENT DOCUMENTS

| | | | |
|---|---|---|---|
| EP | 19500940 | A1 | 7/2008 |
| FR | 2878394 | A1 | 5/2006 |

(Continued)

OTHER PUBLICATIONS

Google Search Result #1 Website Link <Apr. 20, 2009>: http://www.alibaba.com/product-gs/207024281/accessories_for_iPhone_with_build_in.html?

(Continued)

*Primary Examiner* — Brian Ensey
*Assistant Examiner* — Norman Yu
(74) *Attorney, Agent, or Firm* — Russ Weinzimmer & Associates P.C.

(57) ABSTRACT

A passive acoustic booster attachment for a mobile media device is disclosed, the attachment including an attaching portion, and a passive acoustic boosting portion extending from the attaching portion. The attaching portion attaches the passive acoustic booster attachment to the mobile media device. The passive acoustic boosting portion includes an acoustic waveguide, the acoustic waveguide being a conduit capable of guiding sound waves from at least one speaker of the mobile media device towards a listener. In some embodiments, the attaching portion serves as a case that holds and secures the entire perimeter of the mobile media device. In some embodiments, the attaching portion is a clip that can attach to a mobile media device. By guiding the sound waves produced by the speakers of the mobile media device, the passive acoustic booster attachment provides an enhanced listening experience.

16 Claims, 5 Drawing Sheets

(56) References Cited

U.S. PATENT DOCUMENTS

| | | | | |
|---|---|---|---|---|
| 2006/0140439 | A1 | 6/2006 | Nakagawa | |
| 2009/0074226 | A1 | 3/2009 | Eaton et al. | |
| 2010/0124040 | A1* | 5/2010 | Diebel et al. | 361/816 |
| 2010/0315041 | A1* | 12/2010 | Tan | 320/115 |
| 2012/0024619 | A1* | 2/2012 | Lin | 181/179 |
| 2012/0229974 | A1* | 9/2012 | Ting | 361/679.56 |
| 2013/0028446 | A1* | 1/2013 | Krzyzanowski | 381/109 |

FOREIGN PATENT DOCUMENTS

| | | | |
|---|---|---|---|
| GB | 2370179 | A | 6/2002 |
| GB | 2398958 | A | 9/2004 |
| GB | 2404498 | A | 2/2005 |
| JP | 5615469079 | A | 11/1981 |
| JP | 11088975 | A | 3/1999 |
| JP | 2001309000 | A | 11/2001 |
| JP | 2002369287 | A | 12/2002 |
| JP | 2004096289 | A | 3/2004 |
| JP | 2004187031 | A | 7/2004 |
| JP | 2004222208 | A | 8/2004 |
| JP | 2004266473 | A | 9/2004 |
| JP | 2005328442 | A | 11/2005 |
| JP | 2008141589 | A | 6/2008 |
| KR | 0036833 | A | 7/2000 |
| KR | 2034024 | A | 5/2002 |
| KR | 3027465 | A | 4/2003 |
| KR | 4008062 | A | 1/2004 |
| KR | 4062056 | A | 7/2004 |
| KR | 5017809 | A | 2/2005 |
| WO | 02095867 | A1 | 11/2002 |
| WO | 2005073936 | A1 | 8/2005 |
| WO | 2007086524 | A1 | 8/2007 |
| WO | 2008117908 | A1 | 10/2008 |

OTHER PUBLICATIONS

Google Search Result #2 Website Link <Apr. 20, 2009>: http://www.alibaba.com/product-gs/218640483/portable__power__station__battery__with__leather__case__and__speakers__for__iPhone__3G__ipod__touch__accessories__.html.

Google Search Result #3 Website Link <Apr. 20, 2009>: http://www.thinkgeek.com/gadgets/cellphone/b8e5/.

Google Search Result #4 Website Link <Apr. 20, 2009>: http://www.cellphonehits.net/griffins-clearboost-iphone-antenna-booster-hits-the-scene/.

* cited by examiner

MOBILE MEDIA DEVICE CASE/ATTACHMENT FOR PROVIDING PASSIVE ACOUSTIC BOOSTING

FIELD OF THE INVENTION

The present invention relates generally to mobile media devices, and more specifically to accessories for use with mobile media devices.

BACKGROUND OF THE INVENTION

Mobile media devices provide many functions, such as a mobile phone capability, email device capability, web browser capability, and/or music player capability, for example. Mobile media devices generally have speaker outputs to produce sound that can be heard by a user of the device. The speakers of these devices can provide sound output for a variety of purposes, such as a phone conversation, music, news, and/or talk radio, for example.

Traditional speakers embedded within mobile media devices often fail to provide adequate sound quality and/or volume, and they typically direct sound in a manner inconsistent with the goal of providing maximal audio power transmission to the mobile media device user's ears. These deficiencies generally have not been addressed by the prior art, with a few exceptions.

Earphones and/or earbuds, or other separate accessory speaker systems, are sometimes used to provide different sound superior to speakers incorporated within the mobile media device. However, each of these alternatives have significant drawbacks.

Earphones/earbuds or separate accessory speaker systems can detract from the convenience of mobile media device usage. Earphones/earbuds require insertion into a user's ears, which may be undesirable or inappropriate, as in the case of multiple listeners, for example.

Furthermore, separate accessory speaker systems may not be desired, as they are often bulky and therefore do not easily afford a user the opportunity to be mobile. Even with regard to smaller accessory speaker systems that can be attached to the mobile media device for easy transport, the operation of such accessory speakers still requires extra energy, thereby increasing the user's power needs further.

SUMMARY OF THE INVENTION

A mobile media device accessory is claimed and disclosed, for providing passive acoustic boosting to sound emitted from one or more speakers of a mobile media device. In some embodiments the mobile media device accessory is a mobile media device case capable of receiving and holding a mobile media device.

The mobile media device accessory includes a passive acoustic booster capability that provides more audible sound from a mobile media device without using battery power for amplification. The mobile media device accessory is also portable and lightweight, compact, and tightly cooperative with the mobile media device.

By guiding the sound waves produced by the speakers of the mobile media device, the mobile media device accessory acts as a passive acoustic booster, thereby providing an enhanced listening experience. One general aspect of the invention is a passive acoustic booster attachment for a mobile media device, the booster attachment including: an attaching portion, the attaching portion being capable of attaching to a mobile media device; and a passive acoustic boosting portion, the passive acoustic boosting portion extending from the attaching portion, the passive acoustic boosting portion having at least one acoustic waveguide for enhancing sound produced by a speaker of the mobile media device.

In some embodiments, the attaching portion is a case capable of receiving and holding the mobile media device. In other embodiments, the attaching portion is a clip capable of holding onto the mobile media device.

In some embodiments, at least one acoustic waveguide includes: a waveguide input, the waveguide input being positioned adjacent to the speaker when the mobile media device is held by the attaching portion and being capable of receiving sound directly from the speaker; a waveguide body, the waveguide body extending from the waveguide input and being capable of guiding the sound from the waveguide input; and a waveguide output, the waveguide output being positioned at a distal end of the waveguide body so as to receive the guided sound from the waveguide body, the waveguide output also being capable of projecting the guided sound outward from the passive acoustic booster attachment and substantially towards a listener.

In some embodiments, a plane formed by the surface of the waveguide input is not parallel to a plane formed by the surface of the waveguide output. In some of these embodiments, the plane formed by the surface of the waveguide input is substantially orthogonal to the plane formed by the surface of the waveguide output.

In some embodiments, at least one acoustic waveguide forms a horn shape. In some of these embodiments, the horn shape is at least one of: substantially frusto-conical; and tapered.

In some embodiments, the attaching portion maintains the passive acoustic boosting portion in fixed relationship with the speaker of the mobile media device. In some embodiments, the passive acoustic booster attachment further includes an orientation element for adjusting a direction of orientation of the acoustic waveguide with respect to the attaching portion. In some embodiments, the acoustic booster attachment further includes a base stand element that pivots adjustably about a hinge. In some embodiments, the acoustic booster attachment further includes a base stand element that maintains the mobile media device at a fixed tilt angle. In some of these embodiments, the tilt angle ranges between 45 degrees and 90 degrees.

In some embodiments, the attaching portion is made of a one-piece resilient stretchable material, the one-piece resilient stretchable material being stretched so as to secure the mobile media device. In some embodiments, the attaching portion is made of a two-piece substantially rigid material, the two pieces being attachable so as to secure the mobile media device.

In some embodiments, the mobile media device is a mobile phone. In some embodiments, the mobile media device is a MP3 player. In some embodiments, the mobile media device is a mobile tablet computer. In some embodiments, the mobile media device is one of: an iPHONE® brand mobile telephone; an iPOD® brand MP3 player; and an iPAD® brand mobile tablet computer.

Another general aspect of the invention is passive acoustic booster case for a smart phone, the booster case including: an encasing case portion, the encasing portion being capable of receiving and holding the smart phone; and a passive acoustic boosting portion, the passive acoustic boosting portion extending from the encasing portion, the passive acoustic boosting portion having at least one acoustic waveguide for enhancing sound produced by a speaker of the smart phone.

BRIEF DESCRIPTION OF THE DRAWING

The invention will be more fully understood from the following detailed description, in conjunction with the following figures, wherein.

DETAILED DESCRIPTION

Figure 1:
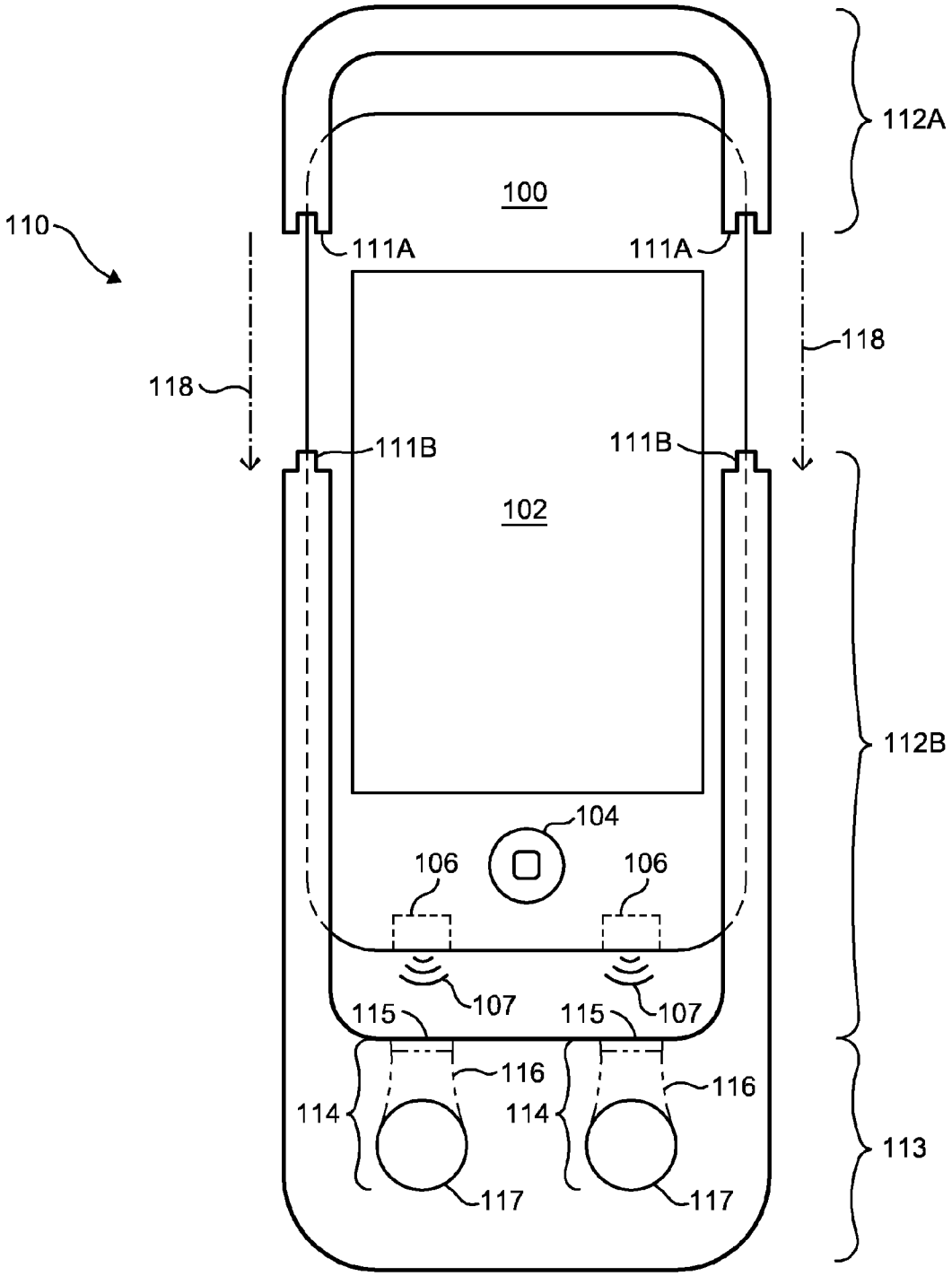
FIG. 1 is an exploded-view elements diagram of an embodiment of a mobile media device case having a passive acoustic booster and a mobile media device to be inserted into the case.

FIG. 1 is an exploded-view elements diagram of an embodiment of a passive acoustic booster attachment and a mobile media device, where the passive acoustic booster attachment is a mobile media device case capable of receiving and holding the mobile media device. A mobile media device 100 with a screen 102 and power button 104 is shown, with built-in speakers 106 embedded within its interior, the speakers emitting sound waves 107. The mobile media device case 110 is shown, including an attaching portion (acting as an encasing portion in this embodiment) 112A, 112B, and a passive acoustic boosting portion 113 extending from the bottom of the attaching portion 112B. The passive acoustic boosting portion 113 includes two acoustic waveguides 114 for guiding the sound waves 107 produced by the speakers 104 of the mobile media device 100, so as to direct the sound waves toward the listener for an enhanced listening experience, including a perceived boosting of the volume sound, for example.

The attaching portion 112A, 112B of the mobile media device case 110 can be a protective case holding the mobile media device 100, as shown in this figure, or it can be a clip or some other attachment that does not encase the mobile media device 100. In the instance of the attaching portion 112A, 112B being a case (as shown), two separate portions can be brought together to form the case, such as a top 112A portion and a bottom 112B portion, as shown in FIG. 1. As shown, female connectors 111A of the top case portion 112A are brought together with male connectors 111B of the bottom case portion 112B, as the top case portion 112A is brought into connection 118 with the bottom case portion 112B. The female connectors 111A and male connectors 111B can then be joined to form the case 112.

In other embodiments, the attaching portion can be a clip, or any other attachment known to one of ordinary skill in the art. Whether a clip, case, or other type of attachment, the attaching portion can attach to the mobile media device in any manner known to one of ordinary skill in the art. For example, the case can snap on to the mobile media device, or snap together around the mobile media device as separate but joinable pieces. In other embodiments, the case can slide onto the mobile media device, or slide together around the mobile media device as separate joinable pieces. In still other embodiments, the case can stretch around and tightly grip the mobile media device (in the instance of an attaching portion made of resilient stretchable material), or fit snugly together around the mobile media device in separate but joinable pieces. The attachment can also attach itself to the mobile media device 100 in any other manner known to one of ordinary skill in the art.

A wide variety of materials can be utilized to construct the passive acoustic boosting attachment, and/or various components thereof. For example, plastic and/or rubber can be utilized for many elements of the invention, including but not limited to the attaching portion 112A, 112B and/or passive acoustic boosting portion 113. In some embodiments, the attaching portion can be made of a one-piece resilient stretchable material capable of being stretched so as to grip the mobile device. In other embodiments, the attaching portion can be made of a two-piece substantially rigid material, the two pieces being attachable so as to hold the mobile device. The present invention also anticipates the use of metal for some or all of the elements of some embodiments of the invention.

In the embodiment shown, the acoustic waveguides 114 each include: a waveguide input 115 positioned adjacent to the speaker 106 and held by the attaching portion 112, and capable of receiving sound directly from the speaker 106; a waveguide body 116 extending from the waveguide input 115 and capable of guiding the sound from the waveguide input 115; and a waveguide output 117 positioned at a distal end of the waveguide body 116, so as to receive the guided sound from the waveguide body 116, and being capable of projecting the guided sound outward from the mobile media device case 110 and substantially towards a listener.

By guiding the initially omni-directional sound waves emanating from the speaker 107, the acoustic waveguides 114 ultimately provide sound output 118 that is directed toward the listener. The projected guided sound 118 is redirected by the acoustic waveguides 114, and in various embodiments the guided sound 118 is enhanced in such a manner as to have greater impedance matching than the sound emitted directly from the speaker 106. In other embodiments, the projected redirected sound 118 can be detected by a listener as having greater perceived amplitude and/or clarity than the sound 107 emitted directly from the speaker 106 of the mobile media device 100.

The acoustic waveguides 114 may have a variety of structural embodiments, but its main purpose is to enhance the sound produced by the mobile media device speaker. The passive acoustic boosting portion 113 can include a single acoustic waveguide 114 to accommodate a single speaker 106, so as to provide a "mono" sound output experience (this embodiment not shown); or it can include two acoustic waveguides to accommodate two speakers, so as to provide a "stereo" sound output experience (as shown in FIG. 1).

One general approach utilized by the acoustic waveguides 114 (and illustrated in this figure) embodies the use of an acoustical "horn" to match the acoustical impedance of the mobile media device speaker 106 to the free-air impedance presented to the overall system as described herein. "Acoustic impedance" is the sound pressure divided by the particle velocity and the surface area, through which an acoustic wave of a given frequency propagates.

A horn can eliminate the abrupt change in acoustic impedance faced by the mobile media device speaker 106, as the speaker's signal moves from the relatively dense speaker diaphragm, to the considerably less dense ambient air. The horn achieves this by converting the speaker membrane's large pressure variations with small displacement, into the ambient air's low pressure variation with large displacement.

This conversion is effected by a gradual increase (often exponential) in the cross sectional area of the horn. Furthermore, a horn can also help direct sound in a desired direction, such as toward a listener of a mobile media device audio message or a viewer of a mobile media device video.

The horn-shaped acoustic waveguide is a passive acoustical component and improves the coupling efficiency between the speaker 106 and the air. The horn can be thought of as an "acoustic transformer" that provides acoustical impedance matching between the relatively dense diaphragm material of the speaker 106, and the lower density surrounding air. The result is greater acoustic output from a given speaker, and effectively greater amplitude of sound from a listener's perspective.

The small cross-sectional area of the speaker 106 restricts the passage of air thus presenting high acoustical impedance to the speaker 106. This allows the speaker 106 to develop a high pressure for a given displacement. Therefore the sound waves at the speaker 106 are of high pressure and low displacement.

The tapered shape of a horn structure of the acoustic waveguides 114 allows the sound waves to gradually decompress and increase in displacement until they reach the horn exit where they are of a low pressure but large displacement. The horn improves the loading and thus gets a better "coupling" of energy from the interface between the speaker 106 and the air, and the pressure variations therefore get smaller as the volume expands and the sound travels up the horn.

Horns have traditionally been used to extend the low frequency limit of a speaker driver such that when mated to a horn, a speaker driver is able to reproduce lower tones more strongly. This kind of mechanical amplification was absolutely necessary in the days of pre-electrical sound reproduction in order to achieve a usable sound level.

The present invention anticipates that the use of an acoustic waveguide 114 within the context of the present invention should be given its widest possible definition. One skilled in the art will recognize that the acoustic waveguide described in the present invention teachings can incorporate a wide variety of forms and materials.

One skilled in the art will recognize that there are a wide variety of materials that can be used in making an acoustic waveguide 114 so as to positively impact the sound transmission properties of the acoustic waveguide 114.

Figure 2:
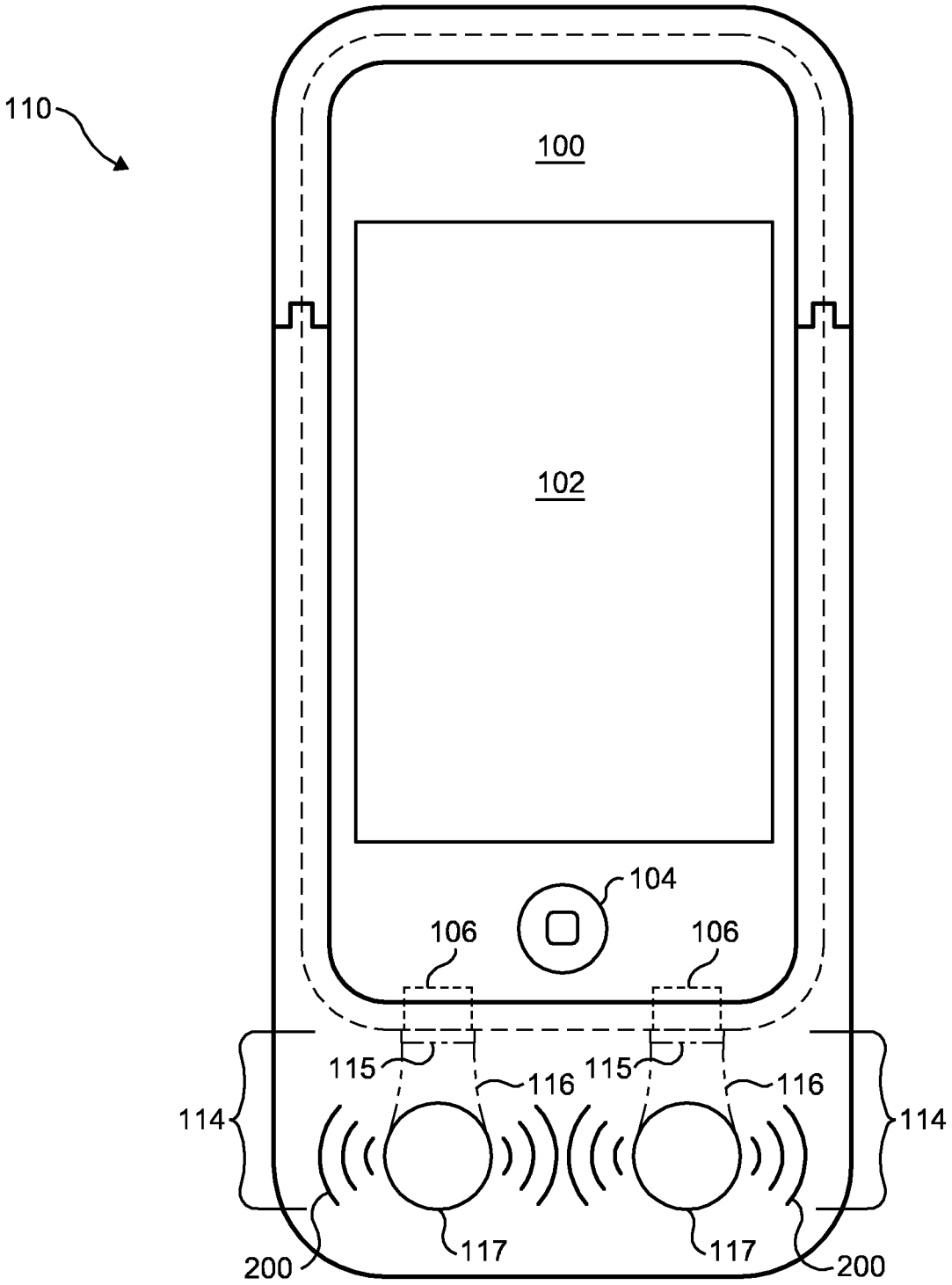
FIG. 2 is a front view of an embodiment of the mobile media device case with the mobile media device encased therein.

FIG. 2 is a front view of an embodiment of the mobile media device case enclosing a mobile media device. Here the mobile media device 100 is shown encased within the mobile media device case 110. In the embodiment shown, the attaching portion (FIG. 1, 112) maintains the passive acoustic boosting portion (FIG. 1, 113) in fixed relationship to the mobile media device 100 and its speaker (not shown here).

In the embodiment shown, the attaching portion (FIG. 1, 112) is capable of receiving and holding the mobile media device 100. Specifically, the attaching portion (FIG. 1, 112) is acting as a protective case in this embodiment, encasing the mobile media device 100 in a manner that both supports the mobile media device 100, but still allows for important features of the mobile media device 100, such as a power button 200 and a touch screen 202, to be viewable and accessible via an opening in the attaching portion.

In the embodiment shown, the attaching portion (FIG. 1, 112) enables a user to protect their mobile media device 100 as well as boost its sound output with no extra power required. The use of the mobile media device 100 is not compromised, as the important features remain exposed for full viewing and easy use.

The mobile media device case 110 is shown, including the attaching portion (FIG. 1, 112) which acts as a case in this embodiment, and a passive acoustic boosting portion (FIG. 1, 113) extending from the attaching portion. The passive acoustic boosting portion includes acoustic waveguides 114 for enhancing the sound 107 produced by the speakers 106 of the mobile media device 100.

The passive acoustic boosting portion can include a single acoustic waveguide to accommodate a single speaker 106, so as to provide a "mono" sound output experience (not shown); or it can include two acoustic waveguides 114 to accommodate two speakers, so as to provide a "stereo" sound output experience (shown here).

In the embodiment shown, each of the acoustic waveguides 114 include: a waveguide input 115 positioned adjacent to the speaker 106 and held by the attaching portion so as to be capable of receiving sound directly from the speaker; a waveguide body 116 extending from the waveguide input 115 and capable of guiding the sound from the waveguide input 115; and a waveguide output 117 positioned at a distal end of the waveguide body 116, so as to receive the guided sound from the waveguide body 116, and then project the guided sound outward from the mobile media device case 110 and substantially towards a listener.

In the embodiment shown, the plane formed by the surface of the waveguide input 115 is substantially orthogonal to the plane formed by the surface of the waveguide output 117, so as to direct sound waves from the speaker of the mobile media device 100 in substantially the same direction in which the screen 102 is oriented. The acoustic waveguides 114 are shaped substantially like curved horns in this embodiment, the waveguide body 116 being tapered as each descends from the waveguide input 115 towards the waveguide output 117.

Figure 3:
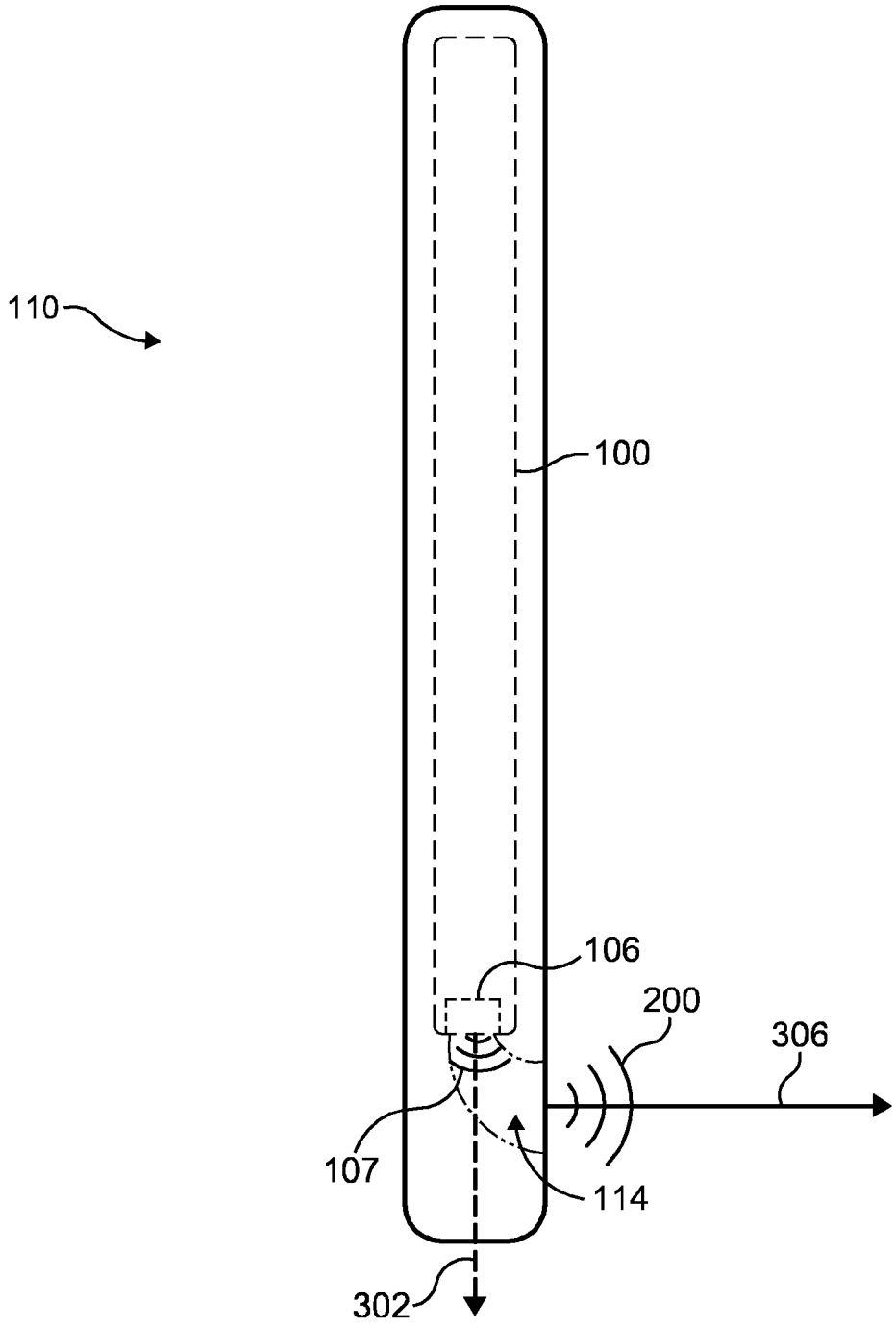
FIG. 3 is a side view of the embodiment shown in FIG. 2.

FIG. 3 is a side view of the embodiment shown in FIG. 2. Here again, the mobile media device 100 is shown housed within the mobile media device case 110. In the embodiment shown, the attaching portion (FIG. 1, 112) is capable of receiving and holding the mobile media device 100. Specifically, the attaching portion (FIG. 1, 112) is acting as a protective case in this embodiment, encasing the mobile media device 100 in a manner that both supports the mobile media device 100, but still allows for important features of the mobile media device 100, such as a power button 104 and a touch screen 202, to be viewable and accessible via an opening in the attaching portion.

In the embodiment shown, the attaching portion (FIG. 1, 112) enables a user to protect their mobile media device 100 as well as boost its sound output with no extra power required. The use of the mobile media device 100 is not compromised, as the important features remain exposed for full viewing and easy use.

The mobile media device case is shown including the attaching portion (FIG. 1, 112), which acts as a case in this embodiment, and a passive acoustic boosting portion (FIG. 1, 113) extending from the attaching portion. The passive acoustic boosting portion 113 includes acoustic waveguides 114 for enhancing the sound 107 produced by the speaker 106 of the mobile media device 100.

The passive acoustic boosting portion (FIG. 1, 113) can include a single acoustic waveguide 114 to accommodate a single speaker 106, so as to provide a "mono" sound output experience (not shown here); or it can include two acoustic waveguides to accommodate two speakers, so as to provide a "stereo" sound output experience (as shown here in FIG. 2).

In the embodiment shown, the plane formed by the waveguide input (FIG. 2, 115), is substantially orthogonal to the plane formed by waveguide output (FIG. 2, 117), so as to direct sound from the speaker of the mobile media device 100 in substantially the same direction in which the screen 202 is oriented.

The sound waves 107 emitted directly from the mobile media device 100 are shown to be propagating vertically downwards 302, while the projected sound waves 107 emanating from the acoustic waveguides 114 out into the air and towards a listener are shown propagating in the orthogonal direction, horizontally towards the right 306, and with a greater effective amplitude from a listener's perspective due to the guided sound waves fostered by the acoustic waveguides 114.

The acoustic waveguides 114 are shaped like a curved horn in this embodiment, the acoustic waveguides 114 being tapered outward as they descend from top to bottom. The shape of the acoustic waveguides 114 is also substantially curved. In some other embodiments, the waveguide can be not curved, but can take the shape of a frusto-cone. In some embodiments, such a frusto-cone can be tapered or flared outwards at its end that is close to the waveguide output.

Figure 4A:
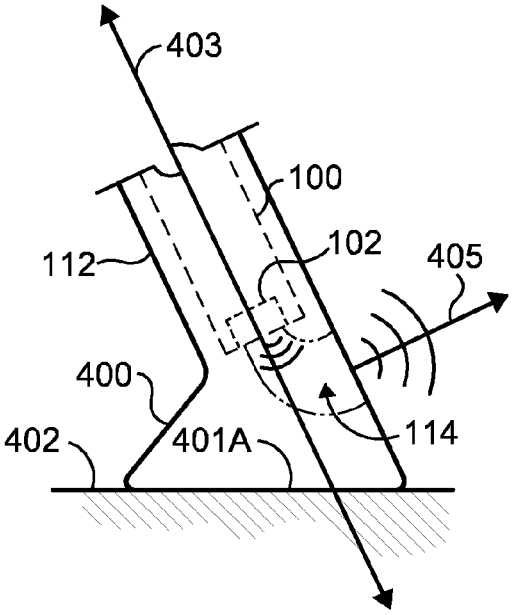
FIG. 4A is a side view of a freestanding embodiment incorporating an integrated base stand formed by the passive acoustic boosting portion.

FIG. 4A is a side view of a freestanding embodiment of the mobile media device case incorporating an integrated base stand formed by the passive acoustic boosting portion. This embodiment includes an integrated base stand 400 for adjusting the orientation of the acoustic waveguides 114, and consequently the direction of sound waves guided by and projected from the acoustic waveguides 114. The orientation element 400 shown in FIG. 4A is an integrated base stand formed by the passive acoustic boosting portion. The integrated base stand 400 shown includes a substantially planar surface 401A extending from the passive acoustic boosting portion at a tilt angle.

The resultant tilt angle enables the acoustic waveguides to be oriented along a tilted axis 403, which in the example of FIG. 4A, can facilitate upward projection of the sound guided by the acoustic waveguides 114, thereby enhancing the sound from a listener's perspective. The substantially planar surface 401A extending from the passive acoustic boosting portion can rest firmly on a substantially flat surface 402 so as to securely provide the tilt axis 403. In some embodiments, the tilt angle ranges between 45 degrees and 90 degrees. As a result, the sound waves guided by the acoustic waveguides are projected at an upward angle 405.

Figure 4B:
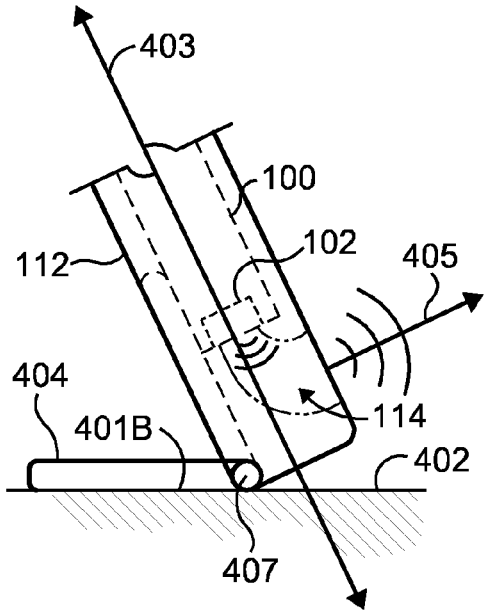
FIG. 4B is a side view of a freestanding embodiment incorporating an integrated retractable base stand that extends from the passive acoustic boosting portion via a hinge.

FIG. 4B is a side view of a freestanding embodiment of an integrated retractable base stand that extends from the passive acoustic boosting portion via a hinge. This embodiment includes another orientation element 404 for adjusting the orientation of the acoustic waveguides 114. The orientation element 404 shown in FIG. 4B is an integrated retractable base stand extendable from the passive acoustic boosting portion. The integrated base stand 404 shown includes a substantially planar surface 401B that pivots about a hinge 407 when extended from the passive acoustic boosting portion at a tilt angle.

The resultant tilt angle enables the acoustic waveguides to be oriented along a tilt axis 403, which in the example of FIG. 4B, can facilitate upward projection of the sound waves guided by the acoustic waveguides 114, thereby enhancing the sound from a listener's perspective. The substantially planar surface 401 B extending from the passive acoustic boosting portion can rest firmly on a substantially flat surface 402 so as to securely provide the tilt axis 403. In some embodiments, the tilt angle ranges between 45 degrees and 90 degrees. As a result, the sound waves guided by the acoustic waveguides are projected at an upward angle 405.

Figure 4C:
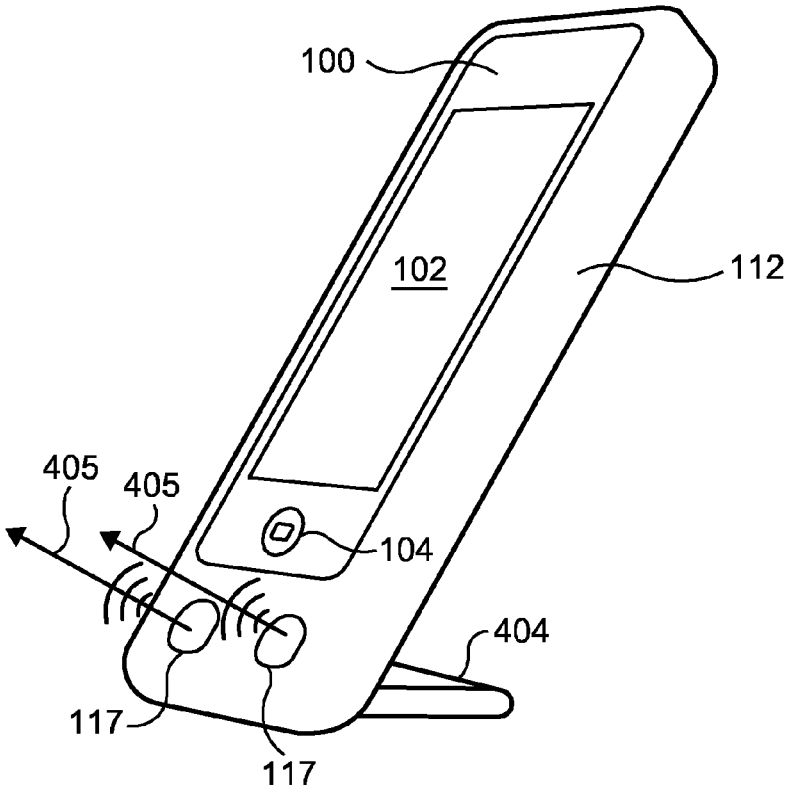
FIG. 4C is an oblique view of an embodiment of the mobile media device case encasing a mobile media device, the mobile media device case including the integrated retractable base stand orientation element of FIG. 4B.

FIG. 4C is an oblique view of an embodiment of the mobile media device case encasing a mobile media device, the mobile media device case including the integrated retractable base stand orientation element of FIG. 4B. FIG. 4C provides a more clear rendering of the manner in which the integrated retractable base stand 404 can direct both the waveguide output 405, and the phone screen 102 output, upward toward a viewer so as to provide for an enhanced listening (as well as viewing) experience.

Figure 5:
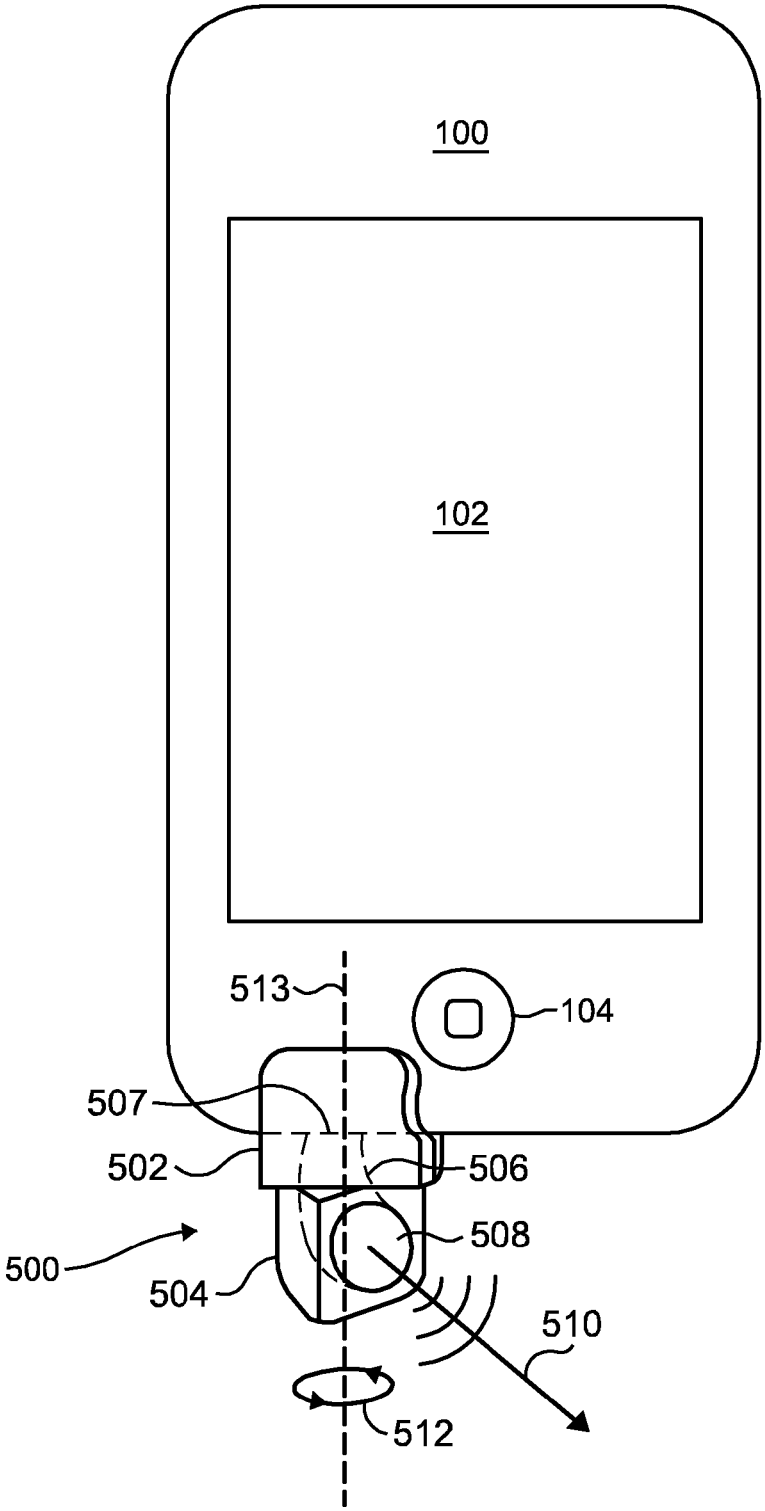
FIG. 5 is a front view of an embodiment of a mobile media device attachment, the attachment being to a mobile media device, where the mobile media device attachment is a clip that includes an orientation element allowing for change in direction of the sound emitted from an acoustic waveguide of the attachment.

FIG. 5 is a front view of an embodiment of a mobile media device attachment as applied to a mobile media device, where the passive acoustic booster attachment is a clip that includes an orientation element allowing for change in direction of the sound emitted from a waveguide. In the embodiment shown, the passive acoustic boosting attachment 500 includes an attaching portion 502 that is not a full case, but rather a clip 502 that can be clipped around an edge of a mobile media device 100.

Whether a clip, case, or other type of attachment, the attaching portion can snap on to the mobile media device, snap together around the mobile media device, slide onto the mobile media device, slide together around the mobile media device, fit tightly or firmly to the mobile media device, fit tightly or firmly around the mobile media device, stretch around and grip the mobile media device, and/or attach in any other manner known to one of ordinary skill in the art.

Also shown is an orientation element 504 for adjusting a direction of orientation of the acoustic waveguide 506. Such rotational adjustment enables a range of possible direction in which speaker sound entering the waveguide input 507 can be guided, and then projected from the waveguide output 508. In the embodiment shown, the passive acoustic boosting portion is also an orientation element. Such an orientation element can be used to adjust the direction 510 of projected sound guided by the acoustic waveguide in around a 360 degree range relative to the vertical axis of the acoustic waveguide. The orientation element shown in FIG. 5 is rotationally adjustable about a vertical axis 512 of the mobile media device.

The present invention anticipates that many preferred embodiments may be tailored to fit a wide variety of mobile media devices, including mobile handheld computers/tablet computers, personal digital assistants (PDAs), MP3 players, mobile telephones, cell phones, smart phones, and the like.

While some preferred exemplary embodiments target popular products such as the Apple Computer, Inc. IPAD® brand mobile tablet computer, Apple Computer, Inc. IPOD® brand MP3 player, and the Apple Computer, Inc. IPHONE@ brand mobile telephone, the teachings of the present invention are not limited to these devices. The invention can be used advantageously with Android® devices, Blackberry® devices, and Windows Mobile® devices, for example.

Other modifications and implementations will occur to those skilled in the art without departing from the spirit and the scope of the invention as claimed. Accordingly, the above description is not intended to limit the invention, except as indicated in the following claims.

What is claimed is:

1. A protective mobile media device case that provides acoustic enhancement of sound produced by a mobile media device when encased therein, the case comprising:

a protective portion that is configured to protectively encase a mobile media device substantially in its entirety, except where necessary to provide access to features of the mobile device when encased therein; and a passive acoustic boosting portion, the passive acoustic boosting portion having at least one acoustic waveguide, the at least one acoustic waveguide having an input opening, an output opening and a waveguide body therebetween, the input opening being located in the boosting portion so that it will be substantially aligned with the at least one speaker of a mobile media device when a mobile device is encased within the protective portion, the at least one acoustic waveguide for enhancing sound produced by the at least one speaker and providing the enhanced sound at the output of the least one acoustic waveguide, wherein the case, as formed by the protective portion and the boosting portion, has a substantially uniform depth between a front and back of the case, and wherein the input, the output and the body of the at least one acoustic waveguide are formed entirely within the substantially uniform depth of the case.

2. The mobile media device case of claim 1, wherein a plane formed by the input opening of the at least one waveguide is not parallel to a plane formed by the output opening of the at least one waveguide.

3. The mobile media device case of claim 1, wherein the plane formed by the input opening of the at least one waveguide is substantially orthogonal to the plane formed by the output opening of the at least one waveguide.

4. The mobile media device case of claim 1, wherein each internal acoustic waveguide forms a horn shape within the substantially uniform depth of the case.

5. The mobile media device case of claim 4, wherein the horn shape is substantially frusto-conical.

6. The mobile media device case of claim 1, wherein the case maintains the at least one acoustic waveguide in substantial alignment with the at least one speaker independent of the spatial orientation of the case.

7. The mobile media device case of claim 1, wherein the protective portion and the boosting portion of the case are together integrally formed as a one-piece resilient stretchable material, the one-piece resilient stretchable material capable of being stretched to protectively encase and secure the mobile media device regardless of its spatial orientation.

8. The mobile media device case of claim 1, wherein the protective portion and the boosting portion of the case are seperably formed of substantially rigid material, the two pieces being attachable to protectively encase and secure the mobile media device regardless of its spatial orientation.

9. The mobile media device case of claim 1, wherein the mobile media device is a mobile phone.

10. The mobile media device case of claim 1, wherein the mobile media device is an MP3 player.

11. The mobile media device case of claim 1, wherein the mobile media device is a tablet computer.

12. The mobile media device case of claim 1, further comprising a base stand element that pivots adjustably about a hinge and that can be pivotally retracted within the case when not in use.

13. The mobile media device case of claim 12, wherein the base stand element can be pivoted to provide a tilt angle that ranges between 45 degrees and 90 degrees.

14. A protective mobile media device case that provides acoustic enhancement of sound produced by a mobile media device when encased therein, the case comprising:

a protective portion that is configured to protectively encase and secure the mobile media device substantially in its entirety therein, independent of spatial orientation of the case;

a passive acoustic boosting portion, the passive acoustic boosting portion having at least one acoustic waveguide, the at least one acoustic waveguide having an input opening, an output opening and a waveguide body therebetween, the input opening being located in the boosting portion so that it will be substantially aligned with the at least one speaker of a mobile media device when a mobile device is encased within the protective portion, the at least one acoustic waveguide for enhancing sound produced by the at least one speaker and providing the enhanced sound at the output of the least one acoustic waveguide; and a base stand element, pivotally coupled to the boosting portion, that can be pivotally retracted within the case when not in use, wherein the boosting portion has a substantially uniform depth between a front and back of the boosting portion, and wherein the input, the output and the body of the at least one acoustic waveguide are formed entirely within the substantially uniform depth of the boosting portion.

15. The mobile media device case of claim 14, wherein the base stand element pivots adjustably about a hinge.

16. The mobile media device case of claim 15, wherein the base stand element can be pivoted to provide a tilt angle that ranges between 45 degrees and 90 degrees.

* * * * *